US009573795B1

(12) United States Patent
Martinez et al.

(10) Patent No.: US 9,573,795 B1
(45) Date of Patent: Feb. 21, 2017

(54) DRILL PIPE SCREEN TRANSPORTER DEVICE

(71) Applicants: Isidro Martinez, Laredo, TX (US); Jerry Parks, McAllen, TX (US)

(72) Inventors: Isidro Martinez, Laredo, TX (US); Jerry Parks, McAllen, TX (US)

( * ) Notice: Subject to any disclaimer, the term of this patent is extended or adjusted under 35 U.S.C. 154(b) by 311 days.

(21) Appl. No.: 14/470,273

(22) Filed: Aug. 27, 2014

(51) Int. Cl.
*E21B 43/10* (2006.01)
*B66C 1/22* (2006.01)

(52) U.S. Cl.
CPC . *B66C 1/22* (2013.01); *E21B 43/10* (2013.01)

(58) Field of Classification Search
CPC ..... E21B 43/10; E21B 7/20; E21B 33/04; E21F 17/02; A01K 97/10
See application file for complete search history.

(56) References Cited

U.S. PATENT DOCUMENTS

| | | | | |
|---|---|---|---|---|
| 2,164,427 | A | 7/1939 | Rhodes | |
| 4,495,073 | A | 1/1985 | Beimgraben | |
| 4,625,796 | A | 12/1986 | Boyadjieff | |
| 5,341,880 | A | 8/1994 | Hagen | |
| 5,586,832 | A | 12/1996 | Zylka | |
| 6,257,792 | B1 | 7/2001 | Read, Jr. | |
| 6,598,685 | B1 | 7/2003 | Mashburn | |
| 6,637,526 | B2 | 10/2003 | Juhasz | |
| 6,793,021 | B1 * | 9/2004 | Fanguy | E21B 19/163 166/380 |
| 7,213,655 | B2 | 5/2007 | Parrott | |
| 7,243,742 | B2 | 7/2007 | Kutryk | |
| 8,016,536 | B2 | 9/2011 | Gerber et al. | |

* cited by examiner

*Primary Examiner* — Giovanna C Wright
*Assistant Examiner* — Brandon Duck
(74) *Attorney, Agent, or Firm* — Suzanne Kikel, Patent Agent

(57) ABSTRACT

A drill pipe screen transporter device rotatably couples a drill pipe screen to a transporter for its insertion and/or extraction into and out of a derrick assembly. A first plate assembly has a first base plate; and first and second spacer plates have arcuate notches for engaging the transporter. U-shaped bolts secure the first plate assembly to the transporter. A second plate assembly rotatably connected to the first plate assembly, has an aperture for supporting the screen. A collar assembly, spacer collar and pivot pin rotatably attach the second base plate to the first base plate for rotation of the screen relative to the transporter. A swivel stopper engages the first base plate of the first plate assembly when the second plate assembly is rotated a predetermined amount. A counterweight located opposite to the swivel stopper returns the second plate assembly to its initial horizontal positioning.

7 Claims, 3 Drawing Sheets

DRILL PIPE SCREEN TRANSPORTER DEVICE

BACKGROUND OF THE INVENTION

1. Field of the Invention

The present invention relates to the art of well drilling, and more in particular to the field of transporting well drilling accessories. More particularly, the present invention relates to a drill pipe screen transporter device, which is fixedly attached to a transporter, and which drill pipe screen transporter device supports a drill pipe screen for inserting and/or extracting the drill pipe screen into and out of a derrick assembly.

2. Brief Description of the Prior Art

During bore hole forming and completion operations, it is necessary to make up and/or break down long strings of tubular articles, such as drill pipes and casings. A string of drill pipe may be thousands of feet long. It may, therefore, be necessary to transport pipe joints which have a length ranging from between approximately 28 to 32 feet from a pipe rack, which is generally located away from the rig up to the rig floor. When being tripped out of the derrick, the string of drill pipe is generally broken into separate joints and returned to the pipe rack.

The handling of oil well pipe is one of the most dangerous jobs on a drilling rig. Some of the pipe joints may weigh thousands of pounds, making it difficult to move the pipe from a horizontal position below and away from the rig into a vertical position overlying the center of the hole in the rig.

In drilling wells of this type, it is common practice to provide a derrick of suitable height in order to accommodate the handling of drill pipes, casing tubing, and other types of pipes used in the drilling of the well and in producing oil from the well. For example, presently a derrick is constructed which is approximately 135 feet high and which is provided with suitable hoisting devices for handling drill pipe in approximately 80 foot sections. These sections are commonly known as "fourbles" and generally are comprised of four standard drill pipes. Each of the drill pipes are about twenty feet long, and are coupled together as a unit.

The use of drilling fluids for the drilling of oil and gas wells is well known. The drilling fluid serves many purposes, such as, for example, suppression of reservoir pressure; lubrication of the drill pipes; and cooling of the bottom hole assemblies. The bottom hole assemblies may contain components such as, for example, bits, stabilizers, and drilling tools. Often times, the bottom hole assemblies contain electronic devices, such as, for example, microprocessors and sensors. The microprocessors are used to collect and/or transmit data which are collected by the sensors located in the bottom-hole assemblies.

Fluids used in drilling may contain different components, such as, for example, mud, chemicals, drill cuttings, and metal shavings. The particle size of these components may vary from one micron to several inches. Additionally, the rig crew may inadvertently drop tools, gloves, rags and other undesired objects into the well bore. The undesirable debris is generally detrimental to the derrick and/or the transporters. For example, this debris can cause failures in the electrical components located in the bottom aperture assemblies of the derrick. Therefore, the derrick operators may find it highly desirable to filter the drilling fluid in order to remove the debris.

In the drilling of a subterranean rock formation, tubing, such as a drill stem assembly or a drill pipe string, conducts drill mud or drilling fluids down hole to the tools in the derrick. These tools may be a mud motors or drill bits. Drilling fluids are circulated down hole through the tubing for a several reasons, one of which, for example, involves the carrying of the drill cuttings up an annulus about the tubing of the derrick, and to the surface for screening, reconditioning and recirculation. In drilling with coiled tubing, mud motors are powered by the flow of drilling fluids and are used to rotate the bit. In conventional rotary drilling, the drill pipe string is used to rotate the drill bits. In either case, there are one or more connections in which a drill pipe screen can be installed in order to intercept the debris and other oversize material which are carried by the drilling fluids and which material could interfere with the down hole tools. Ideally, a retrievable drill pipe screen is used such that the drill pipe screen may be occasionally removed, cleaned, and reinstalled without having to extract the tubing from the derrick hole.

In the drilling of subterranean wells, it is often desirable to filter the drilling fluid so that the drilling fluid does not contain any solids which can plug or damage any of the down-hole tools. It, therefore, has been common practice to install a filter at the mud pump. However, this filter has often proved to be inadequate, providing no protection for debris that may be accidentally dropped into the tubular drill string, especially during the process of assemblage of the tubular drill string on the rig floor. To alleviate this potential problem, mud screens have been inserted into the tubular drill string. However, these mud screens have had the disadvantage of being cumbersome to install and even more difficult to remove and/or to clean. In most instances, the removal of the mud screens can only be accomplished by tripping the pipe out of the hole, which may be impossible if the pipe is stuck. If left in place, the down-hole screen will generally act to block any tools, such as, for example, survey instruments, string shots and other devices which may be necessary for the drilling operation. In some instances, the down-hole screen may become plugged, thereby resulting in limiting the flow of fluid until the down-hole screen is removed and cleaned. Down-hole screens, heretofore, have not been able to be removed from the derrick without running the risk of the debris captured by the down-hole screen escaping from the during its removal, resulting in plugging the down-hole devices that were initially meant to be protected.

Sand control screens are utilized for various reasons in subterranean wells. The term "sand control screen" derives from it early use in preventing the production of sand along with fluids from formations. A sand control screen is typically suspended from the production tubing extending in to the earth's surface and positioned in a wellbore opposite a productive formation. In this way, the sand control screen excludes the produced sand while permitting the valuable fluids to enter the tubing for transport to the earth's surface.

Other operations in which sand control screens are utilized include fracturing and gravel packing operations. In fracturing and gravel packing operations, material referred to as "proppant" or "gravel" is usually suspended in slurry, and pumped down the tubing and into the annular space between the sand control screen and the metal casing lining the wellbore. This material typically accumulates in the annular space and eventually fills the annular space to completely cover the exterior surface of the sand control screen. The sand control screen prevents this material from being pumped back to the earth's surface.

It is well known to those skilled in the art that a screen be retrievably attached to and suspended from production tubing. Such screens provide a means of retrieval and replacement of the screens adjacent to a productive formation.

In the past, choker straps or cinch straps have been used to insert and extract a drill pipe screen from a derrick. However, these straps tend to become loosened or unconnected thereby dropping the drill pipe screen.

These prior art devices generally include a cylindrical screen that has an external fishing neck. However, these types of devices have many disadvantages. For instance, the openings contained in the top have a limited flow-through area. Additionally, the external fishing neck has an inherent weak point at the stem, thereby making it possible for the stem to break off while in the tubular members, which would be highly undesirable and/or dangerous, as those of ordinary skill in the art will recognize.

There is, therefore, a need in the art to provide a device for handling a drill pipe screen in a more efficient and safer manner compared to the prior art devices.

SUMMARY OF THE INVENTION

The present invention provides such a device. The above disadvantages of the devices of the prior art are overcome by providing a drill pipe screen transporter device connectable to a transporter for supporting a drill pipe screen and for inserting and retracting the drill pipe screen from a derrick assembly. More specifically, the device of the invention comprises a first metal plate assembly having two U-shaped metal rings for mounting the drill pipe screen transporter device to the transporter and having a collar assembly with a bore on its lateral face; and a second metal plate assembly having a central aperture with a spacer collar on its lateral face. The first and second metal plate assemblies are attached together by inserting the collar assembly with the bore of the first metal plate assembly into the central aperture and spacer collar of the second metal plate assembly and inserting a threaded pivot pin through the central aperture of the second metal plate assembly and the collar assembly of the first metal plate assembly; tightening the threaded pivot pin; and welding the pivot pin therein. The second metal plate assembly further comprises an extension plate having an aperture for receiving and supporting a drill pipe screen; a weighted stopper tab; and a counter weight member located opposite to the stopper tab for bringing the second metal plate assembly back to a horizontal positioning.

This arrangement and construction of the first metal plate assembly and the second metal plate assembly allow the second metal plate assembly to rotate or pivot, thereby allowing easy extraction and/or insertion of the drill pipe screen into and from a derrick assembly. The drill pipe screen transporter device of the invention is constructed to swivel or pivot so that the derrick operator can have an improved handling of the drill pipe screen.

The drill pipe screen transporter device of the present invention facilitates maneuverability of a drill pipe screen along a derrick assembly and allows the drill pipe screen to be carried up and/or down the derrick assembly by a traveling assembly, in a safer manner compared to the prior art devices used in drilling rig operations.

These and other features and advantages of the present invention will be better appreciated and understood when the following description is read in light of the accompanying drawings.

BRIEF DESCRIPTION OF THE DRAWINGS

The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
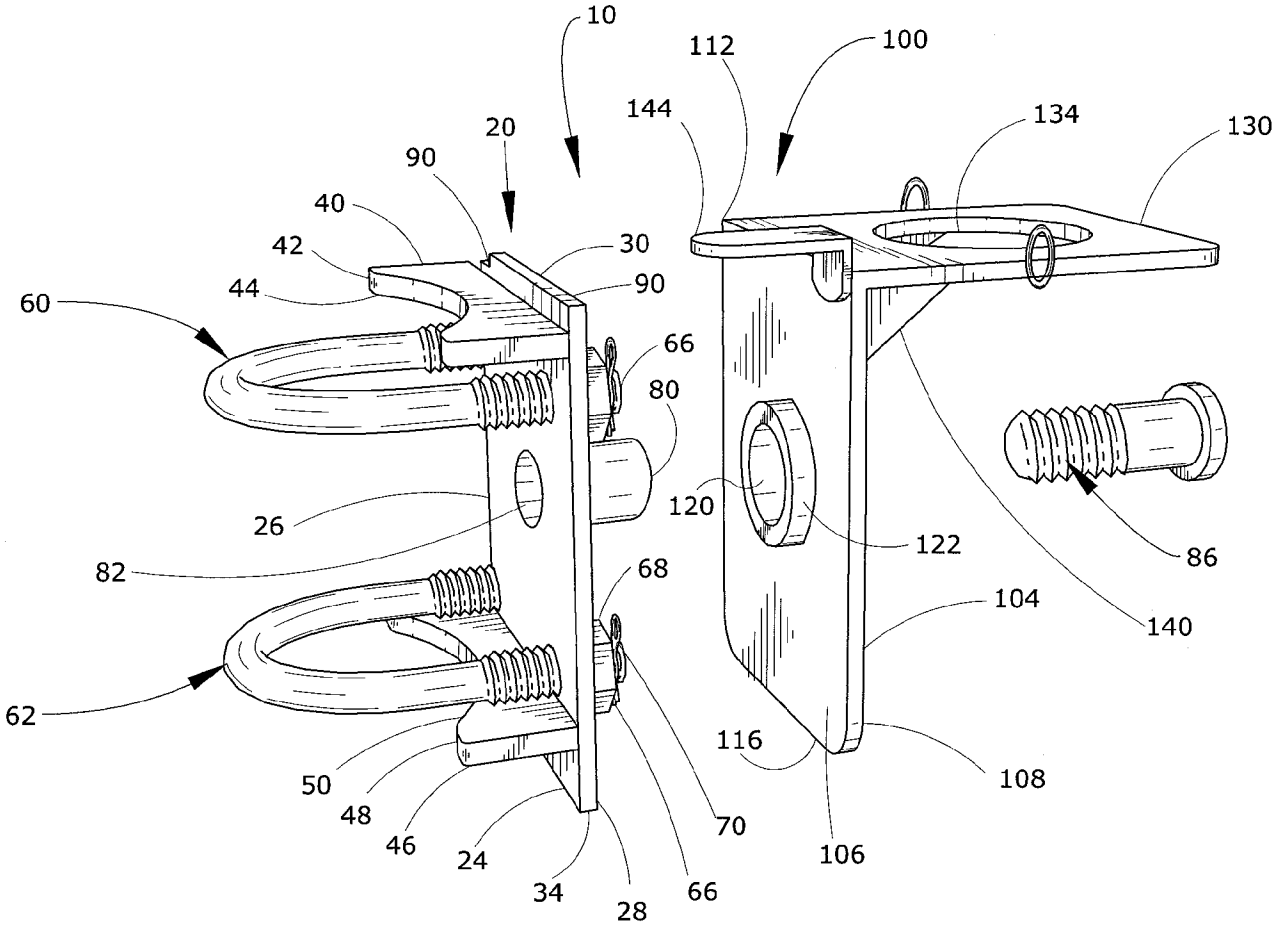
FIG. 1 is a partially exploded, perspective side view of a drill pipe screen transporter device for supporting a drill pipe screen on a transporter embodying the present invention.
Figure 2:
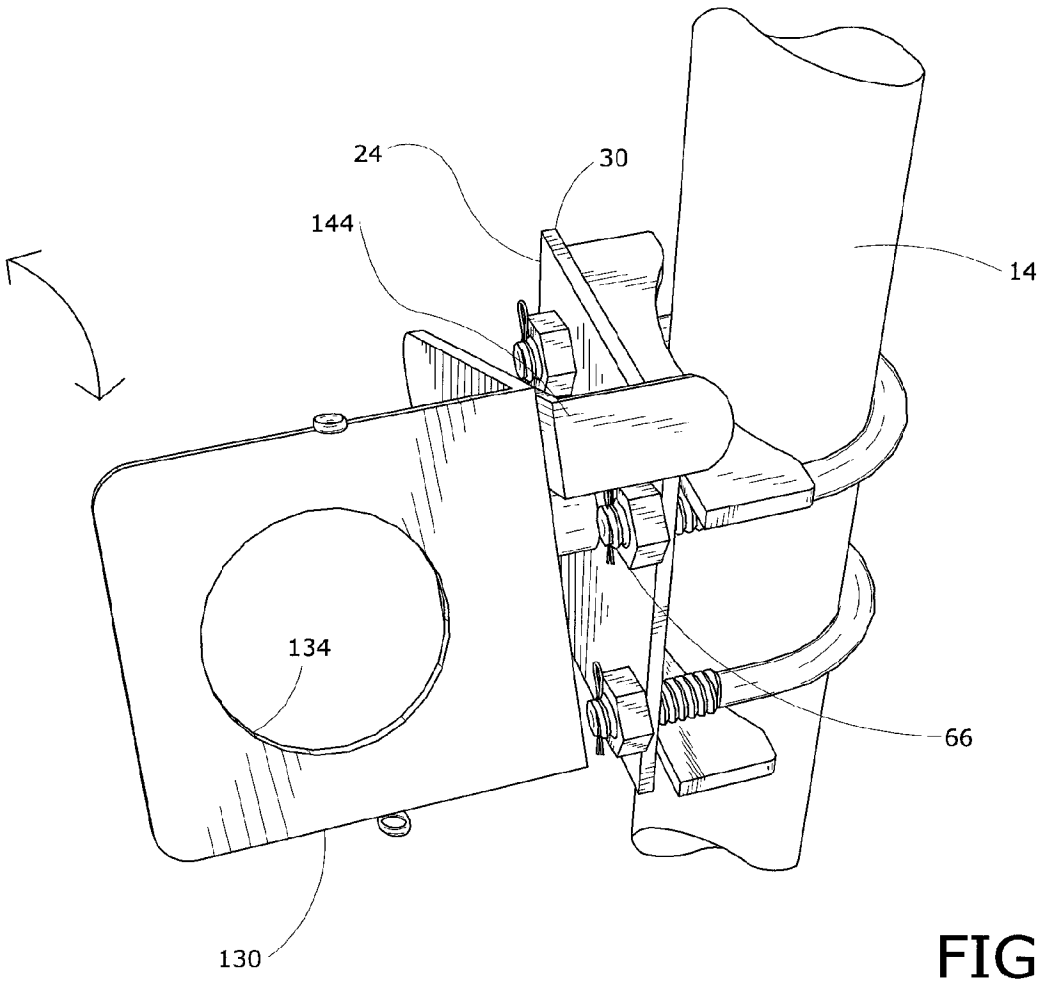
FIG. 2 is a perspective, reversed view of the drill pipe screen transporter device of FIG. 1 connected together and mounted to a transporter.

FIG. 1 shows the drill pipe screen transporter device 10 with its several components disconnected and prior to connection to a transporter 14 which is shown in FIG. 2.

Figure 3:
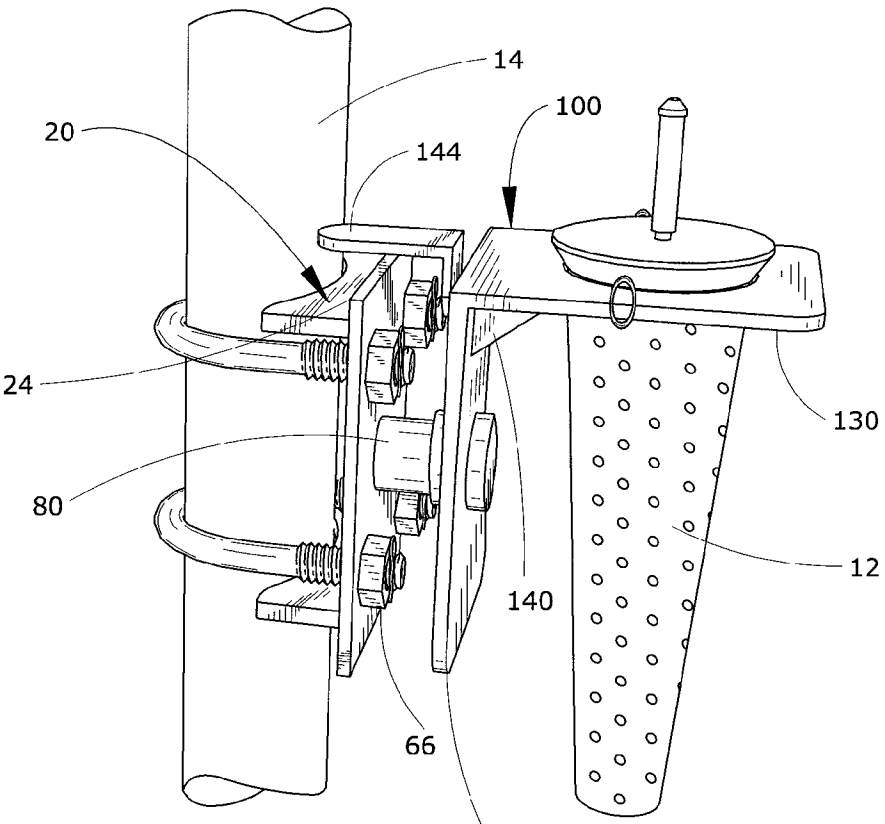
FIG. 3 is a side elevational view of the drill pipe screen transporter device of FIG. 1 mounted to a transporter and supporting a drill pipe screen.

Referring to FIGS. 1, 2 and 3, a drill pipe screen transporter device 10 is constructed to rotatably couple a drill pipe screen 12 to a shaft 14 of a transporter (not shown) and to support the drill pipe screen 12 (FIG. 3) for insertion and extraction of the drill pipe screen 12 into and out of a derrick (not shown) in a manner well-known to those skilled in the art. As can be appreciated to those skilled in the art, drill pipe screen 12 and the transporter are of standard construction and operation.

Referring particularly to FIG. 1, drill screen transporter device 10 comprises a first metal plate assembly 20 which is mounted on shaft 14 of a transporter when drill screen transporter device 10 is in use. First metal plate assembly 20 includes a base plate 24 having a first surface 26 located adjacent to transporter 14 when device 10 is in use; an lateral surface 28 opposite to first surface 26; a first edge 30 which is a top edge when device 10 is in use; and a second edge 34 which is a bottom edge when device 10 is in use. Base plate 24 further includes a first spacer plate 40. First spacer plate 40 is unitary with base plate 24 and is located adjacent to the first edge 30 of base plate 24. First spacer plate 40 has an outer edge 42 which is spaced away from first surface 26 of base plate 24. An arcuate notch 44 is defined in the outer edge 42 of first spacer plate 40 and is constructed to engage transporter 14 when drill pipe screen device 10 is in use.

First metal plate assembly 20 of drill screen transporter device 10 further includes a second spacer plate 46 spaced away from the first spacer plate 40. Second spacer plate 46 is unitary with base plate 24 and is located adjacent to second edge 34 of base plate 24. Second spacer plate 46 has an outer edge 48 which is spaced away from first surface 26 of base plate 24. An arcuate notch 50 is defined in outer edge 48 of second spacer plate 46 and is constructed to engage the transporter when drill pipe screen transporter device 10 is in use.

Two U-shaped bolt assemblies 60 and 62 are fixedly attached to base plate 24 to be interposed between first spacer plate 40 and second spacer plate 46 and to extend away from the first surface 26 of base plate 24 and around transporter 14 in order to couple the first metal plate assembly 20 of the drill pipe screen transporter device 10 to transporter 14 when device 10 is in use. Each U-shaped bolt assembly 60, 62 have a lock nut 66 for securing bolt assemblies 60, 62 to base plate 26. A washer 68 (not shown) and a cotter key 70 are also provided with each lock nut 66 for each U-shaped bolt assemblies 60, 62.

A collar assembly 80 is provided on the lateral surface 28 of base plate 24 and extends away therefrom. Collar assembly 80 has a bore 82 defined therein and a threaded pivot pin 86 is received into bore 82 of collar assembly 80 and preferably is welded into bore 82. Pivot pin 86 extends out of the bore 82 and away from the lateral surface 28 of base plate 24. As best shown in FIG. 1, the first edge or top edge 30 of base plate 24 has a notched out section indicated at reference numeral 90, more about which is discussed herein below.

Still referring to FIGS. 1, 2 and 3, drill pipe screen transformer device 10 further comprises a second metal plate assembly 100. Second metal plate assembly 100 is coupled to first metal plate assembly 20 when device 10 is in use. Second metal plate assembly 100 comprises a base plate 104 having a lateral surface 106 which is located adjacent to lateral surface 28 of base plate 24 of first metal plate assembly 20 when device 10 is in use. Base plate 104 further includes a surface 108 located opposite to lateral surface 106 of base plate 104. Surface 108 is located adjacent to the drill pipe screen 12 when device 10 is in use.

Base plate 104 has a first edge 112 which is a top edge when drill pipe screen transporter device 10 is in use and a second edge 116 which is a bottom edge when device 10 in use. A central aperture 120 is defined in base plate 104 and has a spacer collar, as particularly shown in FIG. 1. Central aperture 120 and spacer collar 122 are located adjacent to collar assembly 80 of first metal plate assembly 20 of device 10 for operation of device 10. Central aperture 120 is sized to accommodate threaded pivot pin 86 so that base plate 104 of second metal plate assembly 100 is rotatably attached to base plate 24 of the first metal plate assembly 20 via threaded pivot pin 86 which extends through central aperture 120 and through the blind ended bore of collar assembly 80 of base plate 24 of first metal plate assembly 20.

Second plate assembly 100 of base plate 104 further includes an engaging plate 130 which engages drill pipe screen 12, as particularly shown in FIG. 3. Engaging plate 130 extends in a perpendicular direction relative to base plate 104 of second metal plate assembly 100. Engaging plate 130 is mounted on base plate 104 adjacent to first edge 112 of base plate 104 in a manner to extend away from surface 108 of base plate 104. As clearly shown in FIG. 3, drill pipe screen 12 is supported by device 10 via engaging plate 130 by being inserted into aperture 134 of engaging plate 130. Aperture 134 of engaging plate 130 is sized and shaped to snugly engage around drill pipe screen 12 when device 10 is in use.

Second metal plate assembly 100 of base plate 104 further includes a counterweight indicated at reference numeral 140 in FIGS. 1 and 3. As shown, engaging plate 130 extends perpendicularly to base plate 104. When drill pipe screen 12 is supported in aperture 134, drill pipe screen 12 extends parallel to base plates 24 and 104. A swivel stopper tab 144 is located on base plate 104 of the second plate assembly 100 and opposite to counterweight 140. Swivel stopper tab 144 is constructed to engage the notched out section 90 (FIG. 1) of top edge 30 of base plate 24 of the first metal plate assembly 20 when the second metal plate assembly 100 is rotated a predetermined amount with respect to the first metal plate assembly 20 of drill pipe screen transporter device 10. Such rotation of second metal plate assembly 100 relative to first metal plate assembly 20 is shown in FIG. 2, where the double headed curved arrow indicates that the second metal plate assembly can be rotated in a clockwise direction where swivel stopper tab 144 engages the notched out section 90 of the first metal plate assembly and then in a counterclockwise direction where the swivel stopper tab 144 rests against top edge 30 of base plate 24. It is to be appreciated that since counterweight member 140 is located opposite to swivel stopper tab 144, counterweight member 140 automatically brings second metal plate assembly 100 back to its initial horizontal positioning when no further forces are exerted onto second metal plate assembly 100.

As can be understood from the figures, especially FIGS. 2 and 3, device 10 couples drill pipe screen 12 to the transporter in a manner which permits drill pipe screen 12 to be rotated or pivoted in a clockwise and/or counterclockwise direction with respect to the transporter while snugly and safely supporting the drill pipe screen 12. As can also be understood from the figures and the above teachings of the invention, drill pipe screen transporter device 10 can be rotated to adequately insert drill pipe screen 12 into a derrick and extract drill pipe screen 12 from a derrick.

It is to be appreciated that when assembled together, second metal plate assembly 100 extends a predetermined distance beyond the top edge 30 in order for second metal plate assembly to rotate relative to first metal plate assembly 20.

While the present invention has been described in connection with the preferred embodiments of the various figures, it is to be understood that other similar embodiments may be used or modifications and additions may be made to the described embodiment for performing the same function of the present invention without deviating there from. Accordingly, it is intended by the appended claims to cover all such changes and modifications as come within the spirit and scope of the invention.

While the invention has been described as the drill pipe screen transporter device comprising metal plate assemblies, it is to be appreciated that the first and second plate assemblies may comprise other appropriate material, such as, for example, plastic.

What is claimed is:

1. A drill pipe screen transporter device for rotatably coupling a drill pipe screen to a transporter and for supporting the drill pipe screen for insertion and/or extraction of the drill pipe screen into and out of a derrick assembly, the drill pipe screen transporter device comprising:

a first plate assembly mountable to the transporter and comprising:

a first base plate;

a first spacer plate extending perpendicularly to the first base plate and having an arcuate notch for encircling and engaging the transporter;

a second spacer plate extending perpendicularly to the first base plate, spaced away from the first spacer plate, and having an arcuate notch for encircling and engaging the transporter;

at least one U-shaped bolt assembly attached to the first base plate and interposed between the first spacer plate and the second spacer plate of the first plate assembly for coupling the first plate assembly to the transporter;

a collar assembly mounted to the first base plate and extending away from the first base plate in a direction opposite to that of the first spacer plate and the second spacer plate; and a second plate assembly connected to the first plate assembly of the drill pipe screen transporter device for carrying the drill pipe screen and comprising:

a second base plate spaced away from the first base plate of the first plate assembly and having an aperture for receiving the collar assembly for rotatably attaching the second base plate of the second plate assembly to the first base plate of the first plate assembly;

an engaging plate extending perpendicularly to and away from the second base plate of the second plate assembly and having an aperture for engaging and supporting the drill pipe screen;

a swivel stopper tab for engaging the first base plate of the first plate assembly when the second plate assembly is rotated a predetermined amount with respect to the first plate assembly;

a counterweight member located opposite to the swivel stopper tab for bringing the second plate assembly back to its initial horizontal positioning; and a pivot pin for rotabably attaching the first plate assembly to the second plate assembly.

2. The drill pipe screen device of claim 1 wherein the U-shaped bolt assembly comprises at least two U-shaped bolt assemblies.

3. The drill pipe screen device of claim 1 wherein the U-shaped bolt assembly comprises a lock nut.

4. The drill pipe screen device of claim 3 wherein the U-shaped bolt assembly further comprises a cotter key associated with the lock nut.

5. The drill pipe screen device of claim 1 wherein the pivot pin is a threaded pivot pin.

6. The drill pipe screen device of claim 1 wherein the swivel stopper tab limits the rotation of the second plate assembly relative to the first plate assembly.

7. A drill pipe screen transporter device for rotatably coupling a drill pipe screen to a transporter and for supporting the drill pipe screen for insertion and/or extraction of the drill pipe screen into and out of a derrick assembly, the drill pipe screen transporter device comprising:

a first plate assembly constructed to be fixedly mounted to a transporter;

a second plate assembly constructed to carry a drill pipe screen;

a pivot pin assembly rotatably connecting the second plate assembly to the first plate assembly for rotating the second plate assembly with respect to the first plate assembly and wherein the drill pipe screen rotates with respect to the transporter while coupled to the transporter;

a swivel stopper tab for engaging the first base plate of the first plate assembly when the second plate assembly is rotated a predetermined amount with respect to the first plate assembly; and a counterweight member located opposite to the swivel stopper tab for bringing the second plate assembly back to its initial horizontal positioning.

* * * * *